US007141344B2

(12) United States Patent
Nakanishi et al.

(10) Patent No.: US 7,141,344 B2
(45) Date of Patent: Nov. 28, 2006

(54) ELECTROSTATIC IMAGE DEVELOPER AND IMAGE-FORMING PROCESS

(75) Inventors: Yasushi Nakanishi, Tokyo (JP); Hirofumi Iemura, Tokyo (JP); Shigehiro Hayashi, Aichi Prefecture (JP)

(73) Assignees: Toyo Ink Manufacturing Co., Ltd., Tokyo (JP); Fujimi Incorporated, Aichi (JP)

( * ) Notice: Subject to any disclaimer, the term of this patent is extended or adjusted under 35 U.S.C. 154(b) by 245 days.

(21) Appl. No.: 10/694,012

(22) Filed: Oct. 28, 2003

(65) Prior Publication Data

US 2004/0157148 A1 Aug. 12, 2004

(30) Foreign Application Priority Data

Nov. 12, 2002 (JP) ..... 2002-327765

(51) Int. Cl.
*G03G 9/00* (2006.01)

(52) U.S. Cl. ..... 430/108.7; 430/122; 430/125; 430/137.19; 430/137.14

(58) Field of Classification Search ..... 430/108.7, 430/122, 125, 137.19, 137.14
See application file for complete search history.

(56) References Cited

U.S. PATENT DOCUMENTS 3,900,588 A 8/1975 Fisher
4,336,318 A 6/1982 Fukumoto et al.
4,654,288 A 3/1987 Hiro et al.
4,702,986 A * 10/1987 Imai et al. ..... 430/120
6,100,000 A 8/2000 Anno et al.

FOREIGN PATENT DOCUMENTS

| | | |
|---|---|---|
| EP | 0 570 886 A1 | 11/1993 |
| GB | 1 402 010 | 4/1975 |
| JP | 55-57874 | 4/1980 |
| JP | 60-136752 | 7/1985 |
| JP | 61-15154 | 1/1986 |

OTHER PUBLICATIONS

Database WPI Week 198610, Derwent Publications Ltd., London, GB; AN 1986-064547, XP002305725.

* cited by examiner

*Primary Examiner*—Mark A. Chapman
(74) *Attorney, Agent, or Firm*—McDermott Will & Emery LLP

(57) ABSTRACT

An image-forming process, which comprises steps of developing an electrostatic latent image on an inorganic photoreceptor with an electrostatic image developer containing 0.1 to 5.0% by weight, based on the toner particles, of silicon carbide fine powder of 0.2 to 1.5 μm in average primary particle size, 10 to 50 $m^2/g$ in specific surface area and 10 to 60% in amount of agglomerated particles, said silicon carbide fine powder being contained in an amount of 0.1 to 5.0% by weight, transferring the developed image to a transfer member, then removing residual toner particles on the photoreceptor by means of a cleaning blade.

15 Claims, 3 Drawing Sheets

ELECTROSTATIC IMAGE DEVELOPER AND IMAGE-FORMING PROCESS

BACKGROUND OF THE INVENTION

1. Field of the Invention

The present invention relates to an electrostatic image developer for developing an electrostatic image in an electrophotographic copier, a laser beam printer, an electrostatic recording apparatus or the like and to a process for forming an image using this electrostatic developer.

2. Description of the Prior Art

Heretofore, it has widely been conducted to obtain a copied image or a recorded image (hereinafter, both are inclusively referred to merely as "copied images") using an electrophotographic copier or a laser beam printer utilizing electrophotography or an electrostatic recording apparatus utilizing electrostatic recording technology.

In the electrophotographic copiers or laser beam printers, formation of copied images utilizing electrophotography is commonly conducted as follows. That is, first, an electrostatic latent image carrier composed of a photoreceptor drum using an inorganic photoconductive material such as amorphous silicon or selenium or an organic photoconductive material (OPC) is positively or negatively charged by means of a charging device. Subsequently, this charged electrostatic latent image carrier is subjected to slit exposure or beam exposure to form thereby an electrostatic latent image on the electrostatic latent image carrier. The thus-formed electrostatic image is developed by a developer containing toner particles, and the developed toner image is transferred to a transfer material such as transfer paper. The transferred toner image is fixed by means of heat rolls, pressure rolls or the like to form a copied image.

As a process for developing the electrostatic image, there have been known (i) a dry-process two-component developing process such as a magnetic brush process or a cascade process which uses a two-component developer containing carrier particles of iron powder, glass powder or resin powder containing a magnetic material and toner particles containing a resin and a colorant as major components; (ii) a one-component developing process of conducting development using only toner particles and not using carrier particles; and (iii) a liquid developing process using an insulating carrier liquid. As the one-component developing process, a one-component magnetic developing process using as a developer an insulating magnetic toner having magnetic powder in the toner particles as described in U.S. Pat. No. 4,336,318 is popular. To the two-component developer and the one-component developer are further added, as needed, additives called external additives such as a fluidizing agent and an abrasive.

On the other hand, the toner partly remains on the electrostatic latent image carrier after transfer of the toner without being transferred. This residual developer is removed from the electrostatic latent image carrier by a cleaning member such as blade cleaning, fur brush cleaning or magnetic brush cleaning, and the thus-cleaned electrostatic latent image carrier is reused. In this occasion, the cleaning member is press-contacted against the electrostatic latent image carrier at a pressure necessary to remove the developer and hence, during repeated use of the electrostatic latent image carrier, the electrostatic latent image carrier is injured or toner particles or toner particle components fixedly deposit onto the electrostatic latent image carrier, leading to generation of deteriorated images. In order to avoid the phenomenon of the fixed deposition of the toner on the electrostatic latent image carrier or to remove the fixedly deposited substances, it has heretofore been widely conducted to incorporate an abrasive in the developer. As to the abrasive, various proposals have so far been made with respect to a using material, a combination of abrasives or a combination of the abrasive and other external additives.

For example, British Patent No. 1,402,010 describes to add a friction-reducing substance and an abrasive in the developer in order to prevent the phenomenon of fixed deposition of toner onto an electrostatic latent image carrier and to prevent generation of flaws on the electrostatic latent image carrier. This technique of using a developer containing both the friction-reducing substance and the abrasive is an effective technique for avoiding the fixed deposition phenomenon of the toner onto the electrostatic latent image carrier. However, addition of the friction-reducing substance in an amount enough to avoid the toner deposition phenomenon involves the defect that it would make it difficult to remove substances having a low electric resistance such as paper dust or an ozone adduct to be generated on, or adhered to, the surface of the electrostatic latent image carrier by repeating use of the photoreceptor. Particularly under an environment of a high temperature and a high humidity, the latent image on the photoreceptor would be injured by the substances having a low electric resistance. Also, selection of the amounts of the friction-reducing substance and the abrasive is delicate, and addition of the abrasive substance in an enough amount so as to stably remove deposits on the photoreceptor would injure the photoreceptor and injure a cleaning blade, resulting in cleaning failure.

As the abrasive material, there have been known colloidal silica, surface-modified oleophilic silica, aluminum silicate, surface-treated aluminum silicate, titanium dioxide, alumina, calcium carbonate, antimony trioxide, barium titanate, calcium titanate, strontium titanate, calcium silicate, magnesium oxide, zinc oxide, zirconium oxide, etc. by, for example, British Patent No. 1,402,010 and U.S. Pat. No. 3,900,588. Also, JP-A-55-57874 describes cerium oxide, aluminum oxide, silicon oxide, zinc oxide, chromium oxide, aluminum sulfate, calcium sulfate, barium sulfate, magnesium sulfate, etc. as abrasives. Further, JP-A-60-136752 proposes a process of forming an image by using a developer containing an inorganic fine powder of 0.2 to 30 $m^2/g$ in BET specific surface area measured according to the hydrogen absorption method generated by a sintering process, and U.S. Pat. No. 4,654,288 proposes an image-forming process by using a developer containing oxide series ceramic fine powder or non-oxide series ceramic fine powder such as silicon carbide, tungsten carbide, aluminum nitride or boron nitride of 0.1 μm or less in particle size, or a combination of the non-oxide series ceramic fine powder and a lubricant.

These conventionally known abrasives or the conventionally proposed techniques involve the problem that, in the case of using a photoreceptor such as amorphous silicon photoreceptor as the electrostatic latent image carrier, a sufficient cleaning effect can not be obtained. Also, in this occasion, when it is intended to avoid the toner deposition phenomenon onto the photoreceptor and obtain a sufficient cleaning effect, it is necessary to incorporate a large amount of inorganic fine powder in a developer. Also, in the case of using a silicon carbide fine powder or the like as an abrasive, there is observed filming of toner upon blade cleaning when used alone or, in case where the photoreceptor is an OPC or selenium series photoreceptor, there arises a problem that these photoreceptors are injured during repeated use thereof.

Further, in order to improve surface deterioration of amorphous silicon due to corona charge, JP-A-61-15154 proposes to conduct development while abrading the surface of the photoreceptor using a toner on the surface of which is externally added 0.05 to 5% by weight, per toner, of silicon carbide of 0.1 to 1 μm. However, in the case of using this developer on the surface of which is externally added silicon carbide, there is involved the problem, as described above, that fusing of the toner onto a photoreceptor drum is liable to take place upon blade cleaning and, in the case of reversal development, generation of white spots are observed in copied images due to the fusing of toner.

SUMMARY OF THE INVENTION

An object of the invention is to provide an image-forming process employed in an electrophotographic copier, a laser beam printer, an electrostatic recording apparatus or the like, which enables one to sufficiently abrade and clean an inorganic electrostatic latent image carrier such as an arsenic-selenium photoreceptor or an amorphous silicon photoreceptor using an abrasive in an amount less than with conventional abrasives; and an electrostatic image developer to be used in the image-forming process.

Another object of the invention is to provide an image-forming process which does not cause fusing of toner upon blade cleaning and which does not injure the photoreceptor even after repeated use thereof; and an electrostatic image developer to be used in the image-forming process.

A further object of the invention is to provide an image-forming process which does not cause dusting of an abrasive into the inside of a recording machine; and an electrostatic image developer to be used in the image-forming process.

Still a further object of the invention is to provide an image-forming process which can constantly form good copied images for an extremely long period of time under any copying environment; and an electrostatic image developer to be used in the image-forming process.

The above-described objects can be attained by an image-forming process and an electrostatic image developer described below.

That is, the invention relates to an image-forming process involving a step of forming an electrostatic latent image on an electrostatic latent image carrier, a step of developing the thus-formed latent image with an electrostatic image developer, a step of transferring the thus-developed image to a transfer member, a step of fixing the transferred image, and a step of scraping the developer remaining on the electrostatic latent image carrier after the transferring step with a cleaning blade, wherein the electrostatic latent image carrier is constituted by an inorganic material and the developer contains at least toner particles and silicon carbide fine powder of 0.2 to 1.5 μm in average primary particle size, 10 to 50 $m^2/g$ in specific surface area and 10 to 60% in amount of agglomerated particles, said silicon carbide fine powder being contained in an amount of 0.1 to 5.0% by weight based on the toner particles.

Also, the invention relates to an electrostatic image developer containing at least toner particles and silicon carbide fine powder, wherein the silicon carbide fine powder has an average primary particle size of 0.2 to 1.5 μm and a specific surface area of 10 to 50 $m^2/g$ and contains 10 to 60% of agglomerated particles, said silicon carbide fine powder being contained in an amount of 0.1 to 5.0% by weight based on the toner particles.

DETAILED DESCRIPTION OF THE INVENTION

The image-forming process of the invention is described in detail by reference to FIG. 1.

Figure 1:
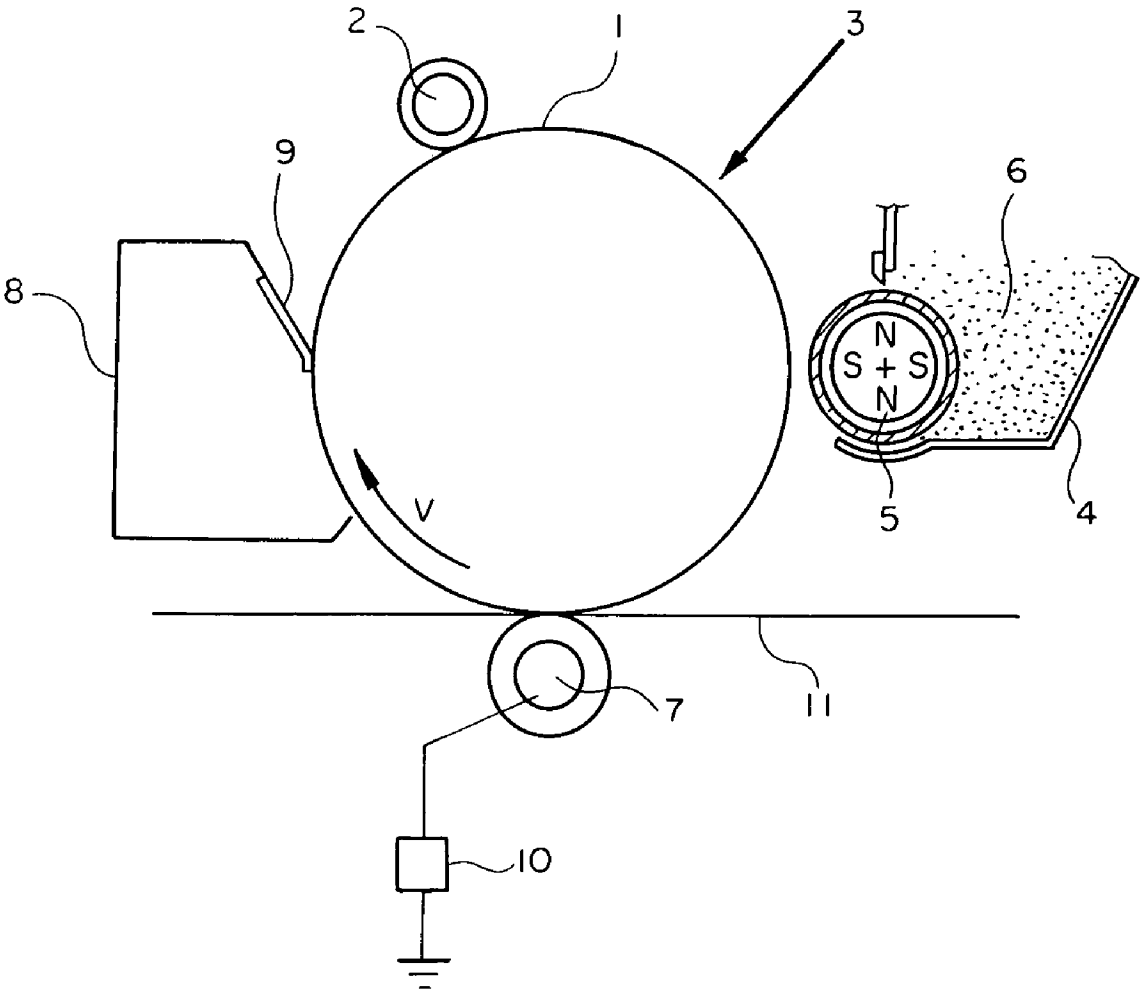
FIG. 1 is a schematic cross-sectional view showing one image-forming apparatus to which the image-forming process of the invention is applied.

In the image-forming apparatus shown by FIG. 1, numeral 1 designates an amorphous silicon photoreceptor of an electrostatic latent image carrier rotating at a speed of V. A charging roller 2 is press-contacted to the surface of the photoreceptor 1 with a pressing force. The charging roller 2 rotates following rotation of the photoreceptor 1 and, by applying a bias voltage to the charging roller 2 from outside, the photoreceptor 1 is charged to a predetermined level with a predetermined polarity. The thus-charged photoreceptor 1 is then scan-exposed by means of a laser beam 3 to form an electrostatic latent image on the photoreceptor 1. The formed electrostatic latent image is developed with a one-component magnetic developer 6 of the invention which is retained within a developing device 4 and which contains a silicon carbide fine powder, thus being visualized successively. The developed toner image is transferred to a transfer member 11 such as paper conveyed between the photoreceptor 1 and a transfer roller 7 in the transferring step. The transfer member 11 onto which the toner image has been transferred is fed to a fixing device not shown, and fixed by means of a heating roll. On the other hand, the photoreceptor 1 from which the toner image has been transferred is cleaned in a scraping manner by a cleaning blade 9 provided in a cleaning device 8. Thereby the toner remaining on the photoreceptor is removed and then the photoreceptor is reused.

However, FIG. 1 shows only one example of the image-forming apparatus to which the image-forming process of the invention is applied, and the apparatus to which the image-forming process of the invention is applied is not limited only to that shown by FIG. 1. That is, since the image-forming process of the invention is an improvement of an image-forming process which employs the technique of developing an electrostatic image formed on an electrostatic latent image carrier with an electrostatic image developer and, after transferring the developed toner image to a transfer member, fixing the transferred image, while removing the developer remaining on the electrostatic latent image carrier using a cleaning blade, the process of the invention may be applicable to any conventionally known or well known image-forming apparatus that permits to apply such process. Therefore, the electrostatic latent image carrier to be used in the image-forming process of the invention is not limited only to the amorphous silicon photoreceptor used in the apparatus shown in FIG. 1, but may be other known photoreceptor such as an arsenic-selenium photoreceptor or selenium-tellurium receptor. However, since the silicon carbide fine powder to be used in the image-forming process of the invention has such a high hardness that it might easily injure the surface of the photoreceptor, a photoreceptor comprising an inorganic material, particularly an inorganic photoreceptor having a high hardness such as an amorphous silicon photoreceptor or an arsenic-selenium photoreceptor, is preferred as the photoreceptor.

In the case of using the amorphous silicon photoreceptor as a photoreceptor in the image-forming process of the invention, an amorphous silicon photoreceptor of 50% or more in Si—O based on the chemical state of Si derived from the peak separation result in Si2p spectrum of the surface of the electrostatic latent image carrier obtained by X-ray photoelectron spectroanalysis (ESCA or XPS) is preferred in view of surface hardness.

Also, the arsenic-selenium photoreceptor to be used in the image-forming process of the invention has a vapor deposition film thickness of preferably 60 to 150 μm. In case where the vapor deposition film thickness is less than 60 μm, there arises a problem with respect to strength whereas, in case where the vapor deposition thickness exceeds 15 μm, there arises a problem with respect to sensitivity, thus such photoreceptor not being preferred.

Additionally, the above-mentioned X-ray photoelectron spectroanalysis is conducted by using, for example, an X-ray photoelectron spectroanalysis apparatus of Model 1600S (made by PHI) under measuring conditions of MgKα (400 W) as an X-ray source and 0.4 mmØ in analyzing region.

Further, in the image-forming process of the invention, charging may not be the contact charging as shown in FIG. 1 but may be non-contact charging utilizing corona discharge using a corotron charger, a scorotron charger or the like. With the contact-charging, too, a charging member may not be the roller as shown in FIG. 1 but may be a blade or a brush. Exposure may be not only the laser beam exposure but also any method such as slit exposure. Development may be conducted not only by the method using a one-component developer as an electrostatic image developer but by the method of using a two-component developer containing a carrier particle and a non-magnetic toner, for example, a magnetic brush developing method. Further, fixing technique may be not only the heat roll fixing technique but also any fixing technique such as a pressure fixing technique.

The electrostatic image developer of the invention to be used in the image-forming process as mentioned above is a developer containing toner particles and silicon carbide fine powder of 0.2 to 1.5 μm in average primary particle size, 10 to 50 $m^2/g$ in specific surface area and 10 to 60% in amount of agglomerated particles, with the content of the silicon carbide fine powder being 0.1 to 5.0% by weight based on the toner particles. To the electrostatic image developer of the invention may further be added other additives called external additives in addition to the toner particles and the silicon carbide fine powder described above. Further, with the two-component developer, carrier particles may be contained. The electrostatic image developer of the invention is successively described below, with the silicon carbide fine powder being the first.

(a) Silicon Carbide Fine Powder

The silicon carbide fine powder to be used in the electrostatic image developer of the invention is required to have an average primary particle size of 0.2 to 1.5 μm, a specific surface area of 10 to 50 $m^2/g$, and an amount of agglomerated particles of 10 to 60%. More preferred average primary particle size, specific surface area and amount of agglomerated particles of the silicon carbide fine powder to be used in the invention are 0.2 to 1.3 μm, 15 to 45 $m^2/g$ and 15 to 55%, respectively and, more preferably, 0.3 to 1.0 μm, 20 to 40 $m^2/g$ and 20 to 50%, respectively. In case where the average primary particle size is less than 0.2 μm, the amount of agglomerated particles increases so much that sufficient cleaning cannot be conducted whereas, in case where it exceeds 1.5 μm, the amount of agglomerated particles becomes so small that fusing of the toner onto an electrostatic latent image carrier takes place which, in the case of reversal development, causes the problem of forming white spots in copied images. In case where the specific surface area is less than 10 $m^2/g$, the primary particle size becomes so large that the amount of agglomerated particles becomes small, thus fusing of the toner onto the electrostatic latent image carrier takes place. On the other hand, in case where the specific surface area exceeds 50 $m^2/g$, the primary particle size becomes so small that the amount of agglomerated particles becomes large, which causes the problem that sufficient cleaning becomes impossible. Further, in case where the amount of agglomerated particles is less than 10%, fusing of the toner onto the electrostatic latent image carrier takes place, which leads to generation of white spots in copied images whereas, in case where it exceeds 60%, silicon carbide stays at the cleaning blade due to too much amount of the agglomerated particles, resulting in the problem of cleaning failure.

The silicon carbide fine powder having the above-described properties is usually produced by agglomerating and precipitating wet-classified fine particles using an agglomerating agent such as polyaluminum chloride. Therefore, in case where high density of Al element deposited on the surface of the silicon carbide fine powder, there results too much agglomeration, thus not being preferred. Also, pulverization for forming fine particles of silicon carbide to be wet-classified is commonly conducted by using iron balls, and hence the pulverized product is contaminated with iron upon this pulverization. This contaminant iron is assumed to function like an agglomerating agent for the silicon carbide in the same way as Al. In case where the density of Fe element deposited on the surface of the final fine powder is at a high level, there tends to result too much agglomeration of the silicon carbide powder. Therefore, the density of Fe element deposited on the surface of the silicon carbide fine powder is preferably not more than 0.5% by weight, and the density of Al element is preferably not more than 0.6% by weight.

The amount of silicon carbide powder added is preferably 0.1 to 5.0% by weight, more preferably 0.2 to 2.0% by weight, based on the amount of the toner particles in the developer. In case where the amount of silicon carbide fine powder added is less than 0.1% by weight, effects of the addition are difficultly obtained whereas, in case where the amount exceeds 5.0% by weight, a photoreceptor is injured due to excessive abrasion even when an amorphous silicon photoreceptor is used as the photoreceptor.

In the invention, the silicon carbide fine powder often provides preferred results when added to one-component magnetic developers in a more amount than to two-component developers.

Additionally, the above-mentioned average primary particle size, specific surface area and amount of agglomerated particles of the silicon carbide fine powder are measured by the following methods.

[Measurement of Average Primary Particle Size]

The measurement is conducted in the following manner using Microtrack FRA (made by Microtrack Co.) as a measuring apparatus.

About 5 g of a sample (slurry) is placed in a 100 cc beaker, and 100 cc of water is poured thereinto, followed by subjecting to ultrasonic treatment for 20 to 30 seconds to prepare a sample for the measurement. Circulation module is washed, and set zero-operation is conducted. In this occasion, when Flux 4ch is 0.05 or more, re-washing is conducted. The above-prepared sample is poured into the circulation module and the concentration is adjusted to a prescribed level. Stirring in the circulation module is stopped for 3 seconds or longer to defoam, and stirring is restarted. Operation of measurement is selected to conduct measurement of size distribution, and an average primary particle size is obtained from the measurement results.

[Measurement of Specific Surface Area]

As a measuring apparatus, FLOWSORB II2300 (made by Shimadzu Corporation) utilizing BET method is used. First, a dry and cooled empty cell is weighed (value A), a sample is placed in the cell, dried in a 105° C. drier for 1 hour or longer, then left in a desiccator to cool. This cell is assembled to the measuring apparatus, followed by deaeration. After completion of deaeration, the cell is cooled in a liquid nitrogen to adsorb a gas. After completion of the adsorption, the sample cell is soaked in water in a beaker to warm and desorb the gas. When stabilized, value B ($m^2$) is read upon desorption. After the measurement, the cell is placed in a drying machine for 20 minutes to dry. After drying, the cell is cooled in a desiccator, then weighed (value C). The specific surface area is calculated according to the following formula using the measured values A, B and C.

$$\text{Specific surface area } (m^2/g) = B \div (C - A)$$

[Measurement of the Amount of Agglomerated Particles]

10 g (in dry weight) of a slurry-like sample is placed in a 500-cc vessel, and distilled water is poured thereinto till amounting to 500 cc, followed by stirring till there exists no precipitate. This dispersion is filtered through a microsieve (Tsutsui Rikagaku Kikai K.K.) of 88 μm in opening (170 mesh). After washing down particles remaining in the vessel (such as particles depositing on the side surface of the vessel) onto the microsieve, 500 cc of distilled water is taken in the vessel and used to wash the microsieve. The total amount of agglomerated particles on the microsieve is recovered on a watch glass, and dried in a drying oven, followed by measuring the weight (weight of dried residue) having remained on the microsieve. The amount of agglomerated particles is calculated from this value according to the following formula.

$$\text{Amount of agglomerated particles } (\%) = [\text{weight of dried residue } (g)/10(g)] \times 100$$

The silicon carbide fine powder having the above-mentioned physical properties to be used in the image-forming process of the invention or in the electrostatic image developer of the invention is produced by pulverizing silicon carbide, classifying the pulverized product by wet classification to obtain silicon carbide particles of 0.2 to 1.5 μm in average primary particle size, adding an agglomerating agent to the classified aqueous water to agglomerate and sediment the silicon carbide fine particles in the classified aqueous solution, and drying and deflocculating the resultant slurry. More specifically, the process is, for example, as follows.

α-Silicon carbide produced according to Acheson process is coarsely pulverized by dry-pulverizing method, and further finely pulverized by wet-pulverizing method. After removing iron by treating the slurry including finely pulverized α-silicon carbide with an acid, the product is washed with water. In the acid treatment, an acid such as hydrochloric acid or sulfuric acid may be used. Subsequently, the resultant slurry is subjected to wet-classifying step necessary times to obtain silicon carbide fine powder having a desired particle size, then an agglomerating agent is added thereto to agglomerate and sediment silicon carbide fine powder. Examples of usable agglomerating agents include polyaluminum chloride, ferrous sulfate, ferric sulfate, ferric chloride, aluminum sulfate, sodium aluminate and active silicic acid, all of which are inexpensive and are characterized in that they agglomerate SiC fine particles efficiently and permit control of pH with comparative ease. After removing the supernatant liquid, the sediment is dried, deflocculated and, if necessary, sieved to remove unnecessarily large particles, thus silicon carbide fine powder with the above-described physical properties being obtained.

Additionally, a conventional process for producing silicon carbide fine powder is commonly as follows.

α-Silicon carbide produced according to Acheson process is coarsely pulverized by dry-pulverizing method, and further finely pulverized by wet-pulverizing method. After removing iron by treating the slurry including finely pulverized α-silicon carbide with an acid, the product is washed with water. Subsequently, the resultant slurry is subjected to wet-classifying step necessary times to obtain silicon carbide fine powder having a desired particle size and, after allowing to stand, the supernatant liquid is removed, the sediment is dried, deflocculated and, if necessary, sieved to remove unnecessarily large particles, thus silicon carbide fine powder with desired particle size being obtained.

However, it is difficult to obtain silicon carbide fine powder of 0.2 to 1.5 μm in average primary particle size, 10 to 50 $m^2/g$ in specific surface area and 10 to 60% in amount of agglomerated particles by this conventional process.

(b) Toner Particles

The electrostatic image developer of the invention may be either one-component magnetic developers using a magnetic toner or two-component developer to be used together with carrier particles. Therefore, the toner particles to be used in the electrostatic image developer of the invention may be either magnetic toner particles containing magnetic powder or non-magnetic toner particles not containing magnetic powder. Also, the toner particles may be positively chargeable or negatively chargeable. The toner particles to be used in the electrostatic image developer of the invention contains at least a binder resin and a colorant.

As the binder resin which constitutes the toner particles, there may be used any of those which have conventionally been used as binder resins for the magnetic toner or the non-magnetic toner not containing the magnetic powder.

Specific examples of the binder resin include styrenic polymers such as homopolymers of styrene or substituted styrene, e.g., polystyrene, poly-p-chlorostyrene and polyvinyltoluene; styrenic copolymers such as styrene-p-chlorostyrene copolymer, styrene-propylene copolymer, styrene-vinyltoluene copolymer, styrene-vinylnaphthalene copolymer, styrene-acryl copolymer, styrene-methyl α-chloromethacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-dimethylaminoethyl acrylate copolymer, styrene-diethylaminoethyl acrylate copolymer and styrene-butyl acrylate-diethylaminoethyl methacrylate copolymer; cross-linked styrenic copolymers; polyester resins such as polyester resins having as a constituting unit a monomer selected from among aliphatic dicarboxylic acids, aromatic dicarboxylic acids, aromatic dialcohols and diphenols and cross-linked polyester resins; and others such as polyvinyl chloride, phenol resin, modified phenol resin, maleic resin, rosin-modified maleic resin, polyvinyl acetate, silicone resin, polyurethane resin, polyamide resin, epoxy resin, polyvinyl butyral, rosin, modified rosin, terpene resin, xylene resin, aliphatic or alicyclic hydrocarbon resin and petroleum resin.

Examples of the acrylic monomer constituting the styrene-acrylic copolymers include acrylic acid, methacrylic acid, and (meth) acrylic esters such as methyl acrylate, ethyl acrylate, butyl acrylate, dodecyl acrylate, octyl acrylate, 2-ethylhexyl acrylate, phenyl acrylate, methyl methacrylate, ethyl methacrylate, butyl methacrylate and octyl methacrylate. Further, examples of the monomers to be used together with these styrenic or acrylic monomers include acrylonitrile, methacrylonitrile, acrylamide, maleic acid, maleic acid half esters such as butyl maleate, diesters thereof, vinyl acetate, vinyl chloride, vinyl ethers such as vinyl methyl ether, vinyl ethyl ether, vinyl propyl ether and vinyl butyl ether, and vinyl ketones such as vinyl methyl ketone, vinyl ethyl ketone and vinyl hexyl ketone.

Also, as a cross-linking agent for producing the above-mentioned cross-linked styrenic polymers, there may mainly be illustrated those compounds which have two or more unsaturated bonds. Specifically, aromatic divinyl compounds such as divinylbenzene and divinylnaphthalene, carboxylic acid esters having two or more unsaturated bonds such as ethylene glycol diacrylate and ethylene glycol dimethacrylate, divinyl compounds such as divinylaniline, divinyl ether, divinylsulfide and divinylsulfone, and compounds having three or more unsaturated bonds may be used alone or as a mixture thereof. The above-described cross-linking agents are used in an amount of 0.01 to 10% by weight, preferably 0.05 to 5% by weight, based on the weight of the binder resin.

These resins may be used alone or as a mixture of two or more of them. Of these resins, styrenic polymers and polyester resins are particularly preferred, since they show excellent charging properties. Also, styrenic copolymers having at least one peak in the region of $3\times10^3$ to $5\times10^4$ in a molecular weight distribution measured by GPC (gel permeation chromatography) and at least one peak or shoulder in the region of $10^5$ or more and, further, a resin composition whose molecular weight distribution is adjusted to be as described above by combining two or more resins, for example, combining the afore-mentioned styrenic resin and the styrene-acrylic copolymer or combining two or more kinds of the styrene-acrylic copolymers are preferred in view of pulverizability and fixability of resulting toners.

Further, in the case of employing the press-fixing system, binder resins for press-fixable toners may be used. Examples of such resins include polyethylene, polypropylene, polymethylene, polyurethane elastomer, ethylene-ethyl acrylate copolymer, styrene-isoprene copolymer, linear saturated polyester, paraffin and other waxes.

Also, as colorants for the toner particles, any of those dyes and pigments which have conventionally been known as colorants may be used.

As such known dyes and pigments, carbon black, aniline black, acetylene black and iron black may preferably be used as black colorants.

As yellow colorants, those compounds which are represented by condensed azo compounds, isoindolinone compounds, anthraquinone compounds, azo metal complex compounds, methine compounds and allylamide compounds are used. Specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181, 191, etc. are preferably used.

As magenta colorants, condensed azo compounds, diketopyrrolopyrrole compounds, anthraquinone compounds, quinacridone compounds, basic dye lake compounds, naphthol compounds, benzimidazolone compounds, thioindigo compounds and perrylene compounds are used. Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221, 254, etc. are preferably used.

As cyan colorants, copper phthalocyanine compounds and the derivatives thereof, anthraquinone compounds, and basic dye lake compounds may be utilized. Specifically, C.I. Pigment Blue 1, 7, 15, 15:1, 15:2, 15:3, 15:4, 60, 62, 66, etc. are preferably used.

These colorants are commonly added in an amount of 0.1 to 20 parts by weight, preferably 0.3 to 20 parts by weight, based on 100 parts by weight of the binder resin. Additionally, in case where the magnetic powder also functions as a colorant in a magnetic toner, other colorant may be used, if necessary. In the case of using other colorant, there may be used, for example, carbon black, copper phthalocyanine, iron black or the like.

In case where the toner particles in the electrostatic image developer of the invention are magnetic toner particles, the toner particles further contain magnetic powder. As the magnetic powder, powder of ferromagnetic metal such as iron, cobalt, nickel or manganese, powder of an alloy of the ferromagnetic metals, and powder of a compound containing iron, cobalt, nickel or manganese such as γ-iron oxide, magnetite or ferrite. These magnetic fine particles have a BET specific surface area measured by the nitrogen absorption method of preferably 2 to 20 $m^2/g$, particularly preferably 2.5 to 12 $m^2/g$, and a Mohs' scale of hardness of preferably 5 to 7. Also, particle size of the magnetic powder is 0.1 to 0.8 μm, preferably 0.3 to 0.5 μm, and the content of the magnetic powder is 10 to 70% by weight, preferably 15 to 50% by weight, based on the amount of the toner.

In the toner particles of the electrostatic image developer of the invention may be incorporated, as needed, a conventionally known charge-controlling agent. As the charge-controlling agent, a positive charge-controlling agent or a negative charge-controlling agent may be used depending upon polarity of an electrostatic image on an electrostatic latent image carrier to be developed. As the positive charge-controlling agent, Nigrosine dyes and metal derivatives of fatty acids, triphenylmethane series dyes, quaternary ammonium salts (e.g., tributylbenzylammonium 1-hydroxy-4-naphthosulfonate and tetrabutylbenzylammonium tetrafluoroborate), diorganotin oxides (e.g., dibutyltin oxide, dioctyltin oxide and dicyclohexyltin oxide), diorganotin borates (e.g., dibutyltin borate, dioctyltin borate and dicyclohexyltin borate), etc. may be used alone or in combination of two or more of them. Of these, Nigrosine series dyes and quaternary ammonium salts are preferred.

On the other hand, as the negative charge-controlling agent, there may be illustrated carboxyl group-having compounds (e.g., metal salts or metal chelates (complexes) of salicylic acid or salicylic acid derivative), metal complex salt dyes, fatty acid soaps, metal naphthenates, etc.

These charge-controlling agents are usually used in an amount of 0.1 to 10 parts by weight, preferably 0.5 to 8 parts by weight, based on 100 parts by weight of the binder resin.

To the toner particles of the invention may be added other additives having conventionally been used upon production of toner particles within a range of not causing substantially adverse influence. As such additives, there maybe illustrated, for example, aliphatic hydrocarbons, metal salts of fatty acids, higher fatty acids, fatty acid esters or the partially saponified products thereof, silicone oil and various waxes which improve releasing properties (offset-preventing properties) upon heat roll fixing. Of these, low-molecular polyethylene or low-molecular polypropylene having a weight average molecular weight of 1,000 to 10,000, microcrystalline wax, and a wax such as carnauba wax, sazol wax, paraffin wax, etc. are preferred. As other additives, there may be illustrated a fluidizing agent, a lubricant, a conductivity-imparting agent, an abrasive, etc.

The toner particles to be used in the electrostatic image developer of the invention are produced preferably by preliminarily mixing the toner-constituting components described hereinbefore in a mixing apparatus such as a dry blender, Henschel mixer or ball mill, melt-kneading the mixture by means of a heat kneader such as a heat roll, a kneader or a uniaxial or biaxial extruder, cooling the resultant kneaded product, pulverizing it and, if necessary, classifying to obtain particles of a desired particle size. However, process for producing the toner particles to be used in the invention is not limited to this knead-pulverizing process, and there may be employed any of conventionally known processes such as a process of dispersing the toner-constituting materials in a binder resin solution and spray-drying the dispersion and a process of preparing an emulsion suspension by mixing the predetermined materials in a monomer constituting a binder resin, then conducting polymerization to obtain toner particles. The toner particles to be used in the invention have an average particle size of preferably 3 to 35 μm, more preferably 5 to 25 μm. With toners having a smaller particle size, the toner particles to be used have a size of about 4 to about 10 μm. In case where the electrostatic image developer of the invention is an insulating magnetic toner, the toner particles have an electric resistance of preferably $10^{10}$ Ω·cm or more, more preferably $10^{13}$ Ω·cm or more.

(c) Carrier Particles

In case where the electrostatic image developer of the invention is a two-component developer, carrier particles are also used in the electrostatic image developer of the invention. The carrier particles to be used in the two-component developer of the invention may be any of those carrier particles which have conventionally been used in two-component developers. For example, powders of ferromagnetic metals such as iron powder, powders of ferromagnetic metal alloys, ferrite powders constituted by elements of nickel, copper, zinc, magnesium, barium, etc. and magnetite powder are illustrated as preferred ones. These carrier particles may be covered with a resin such as a styrene-methacrylate copolymer, a styrene polymer or a silicone resin. As methods for covering the carrier particles with the resin, there may be any of known methods such as a method of dissolving a covering resin in a solvent, coating it on core particles by a dipping method, a spraying method or a fluidized bed method, drying the coated particles and, if necessary, heating them to cure the coated film. Also, the carrier particles to be used have an average particle size of usually 15 to 500 μm, preferably 20 to 300 μm.

(d) Preparation of an Electrostatic Image Developer

The electrostatic image developer of the invention is prepared by dry-mixing toner particles, the abovementioned silicon carbide fine powder and, as needed, other additives. With two-component developers, carrier particles are further mixed as needed. In this occasion, the amount of silicon carbide fine powder added is preferably 0.1 to 5.0 parts by weight per 100 parts by weight of the toner particles as has been described hereinbefore. More preferred amounts of the silicon carbide fine powder to be added as to the one-component magnetic developer and the two-component developer are separately described below. With the one-component magnetic developer, the more preferred amount is 0.2 to 2.0 parts by weight per 100 parts by weight of the toner whereas, with the two-component developer, the more preferred amount is 0.1 to 1.0 part by weight per 100 parts by weight of the toner particles.

As the additives to be used together with the silicon carbide fine powder in preparing the electrostatic image developer, there may be illustrated those publicly known or well-known external additives which have conventionally been known to be used together with toner particles in preparing electrostatic image developers, such as a lubricant, a fluidizing agent and other abrasives than silicon carbide. Examples of the lubricant include polytetrafluoroethylene and zinc stearate, examples of the fluidizing agent include fine particles of silica, alumina, titania, magnesia, amorphous silicon-aluminum co-oxide and amorphous silicon-titanium co-oxide having or not having been treated with a hydrophilicity-imparting agent such as polymethylmethacrylate, polystyrene, silicone, dichlorodimethylsilicone or hexamethyldisilazane, and examples of other abrasives than silicon carbide include fine particles of strontium titanate, calcium titanate, calcium carbonate, chromium oxide and tungsten carbide. Also, metal oxides such as tin oxide may be added as conductivity-imparting agents. However, these examples are only illustrative ones of the additives, and the additives to be added to and mixed in the electrostatic image developer of the invention are not limited only to them.

Hereinafter, the invention is described in more detail by reference to examples, but the invention is not limited at all by the following examples. Additionally, in the following description, "parts" are all "parts by weight".

First, the process for preparing silicon carbide fine powder used in Example 1 is specifically described. Silicon carbide fine powders used in Examples 2 to 6 and Comparative Examples 1 and 2 can be prepared in the same manner as follows by modifying the amount of an agglomerating agent to e added or adjusting the primary particle size of classified fine particles.

[Preparation of Silicon Carbide Fine Powder]

α-SiC raw material for wet pulverization, which is obtained by synthesis according to the Acheson process and dry pulverization ($D_{50}$ (average particle size)=25 μm; S.A. (specific surface area)=0.07 $m^2/g$ (BET method; hereinafter the same)), water and iron balls were thrown into a pulverizing mill, followed by conducting wet pulverization to prepare a pulverization slurry containing silicon carbide particles ($D_{50}$=10 μm; S.A.=0.07 $m^2/g$). Subsequently, the pulverization slurry was transferred to a resin-made tank, and hydrochloric acid was added thereto under stirring till pH of the slurry became 2, followed by continuing the stirring to conduct sufficient washing with acid, thus iron being removed. The iron-free slurry was allowed to stand in the tank and, after removal of the supernatant liquid, a sufficient amount of water was added thereto, followed by sufficient mixing. This operation was repeated till pH of the slurry became 6 to thereby prepare a raw slurry for classification. Next, water was added to the raw slurry for classification to adjust the concentration to 50% by weight, levigation classification was conducted to prepare a classified slurry 1 containing silicon carbide powder ($D_{50}$=6.0 μm). Subsequently, the classified slurry 1 was twice subjected to wet classification using a cyclone classifying apparatus to prepare a classified slurry 2 containing silicon carbide fine particles ($D_{50}$=1.0 μm). Here, $Fe^{2+}$ concentration of the classified slurry 2 was measured, but no $Fe^{2+}$ was detected. Subsequently, the classified slurry 2 was subjected to accurate classification using a centrifugal classification apparatus to obtain a classified slurry 3 containing silicon carbide fine powder ($D_{50}$=0.42 μm; S.A.=26.3 $m^2/g$). Under stirring, to this classified slurry 3 was added a polyaluminum chloride solution till agglomeration of the silicon carbide fine particles in the slurry was visually observed and, after allowing to stand, the supernatant liquid was removed to obtain classified slurry 3.

After well drying the classified slurry 3 in a drying machine, the dried product was crushed by means of a deflocculating machine to obtain silicon carbide fine powder. S.A. and the amount of agglomerated particles of the silicon carbide fine powder were measured and were found to be 26.3 $m^2/g$ and 40.6%, respectively. Also, measurement of the concentration of Fe element and that of Al element depositing onto the surface of the silicon carbide fine powder revealed that they were 0.21% by weight and 0.25% by weight, respectively.

Additionally, $D_{50}$ of silicon carbide powders in the silicon carbide raw material for pulverization, slurry including the pulverized silicon carbide raw material, and classified slurries 1 to 3, the amount of agglomerated particles in the silicon carbide fine powders, concentrations of Fe element and Al element deposited onto the surface of the silicon carbide fine powders, and $Fe^{2+}$ concentration in the classified slurries were conducted in the following manner. $D_{50}$ of silicon carbide fine particles in the silicon carbide raw material for pulverization and slurry including the pulverized silicon carbide raw material:

Average particle size was determined using Multisizer II (made by Coulter).

$D_{50}$ of Silicon Carbide Powder in the Classified Slurries 1 to 3:

The average particle size was determined according to the afore-mentioned "method for measuring average particle size" using Microtrack FRA (made by Microtrack).

Amount of Agglomerated Particles of Silicon Carbide Fine Powder:

Measurement was conducted according to the aforementioned "method for measuring the amount of agglomerated particles", followed by calculation.

Concentration of Fe Element Deposited onto the Surface of Silicon Carbide Fine Powder:

Measurement was conducted according to the following method using a spectrophotometer (UV-1240; made by Shimadzu Corporation), followed by calculation.

1.0 g of silicon carbide fine powder and 50 ml of (1+1) hydrochloric acid solution were placed in a casserole with a handle, and were boiled for 10 minutes. After cooling, the mixture was filtered through a filter paper (Advantec 5C; made by Toyo Roshi K.K.), and the residue was washed with (1+100) hydrochloric acid solution. The filtrate and the washing were transferred to a 250-ml messflask, and water was added thereto to the mark to prepare a sample. Two drops of a potassium permanganate solution (0.1N) were added to 50 ml of this sample, followed by sufficient stirring to confirm color change to a pale red color. If the color does not become pale red, the potassium permanganate solution is further added. 10 ml of a 10% potassium thiocyanate solution was added to the pale red sample to prepare a solution to be measured. The solution was subjected to measurement by means of the aforesaid spectrophotometer at a wavelength of 370 nm, and the concentration of Fe element deposited onto the surface of silicon carbide fine powder was calculated according to the following formula.

$$\text{Concentration of Fe element (\% by weight)} = \text{measured value (ppm)} \times 10^{-3} \times 0.25(L)/1.0(g) \times 100$$

Concentration of Al Element Deposited onto the Surface of Silicon Carbide Fine Powder:

Measurement was conducted using a high frequency plasma-emitting analyzer (ICPS-10001V; made by Shimadzu Corporation), and the concentration was calculated based on the value.

0.5 g of silicon carbide fine powder was placed in a platinum crucible, and 5 ml of nitric acid and 5 ml of hydrofluoric acid were added thereto. After evaporating to dryness, about 30 ml of ultra-pure water and 1 ml of nitric acid were added thereto, followed by heating till vapor gave off. Then, the sample in the platinum crucible was transferred to a 100-ml messflask, and pure water was added to the mark to prepare a solution to be measured. This solution and an Al-free sample (BLANK) were subjected to measurement in the high frequency plasma-emitting apparatus, and the concentration of Al element deposited onto the surface of silicon carbide fine powder was calculated according to the following formula.

$$\text{Concentration of Al element (\% by weight)} = [\text{measured value} - \text{BLANK}]\ (\text{ppb}) \times 10^{-6} \times 0.1(L)/0.5(g) \times 100$$

Concentration of $Fe^{2+}$ in a Classified Slurry:

Measurement was conducted using an ion-testing paper (Advantec ANION-CATION TEST PAPER $Fe^{2+}$; made by Toyo Roshi K.K.).

EXAMPLE 1

Preparation of Developer

| | |
|---|---|
| Styrene-acryl copolymer | 100 parts |
| Magnetic material (magnetite) | 93 parts |
| Nigrosine dye | 6 parts |
| Synthetic paraffin wax | 3 parts |

The above-described components were uniformly mixed, kneaded, pulverized, and classified to obtain positively chargeable toner particles of 10.4 μm in average particle size. Subsequently, 0.3 part of silica fine powder having been treated with dichlorodimethylsilane and 1.0 part of silicon carbide fine powder of 0.42 μm in average primary particle size, 26.3 $m^2/g$ in specific surface area, 40.6% in amount of agglomerated particles, 0.21% by weight in amount of deposited Fe element and 0.25% by weight in amount of deposited Al element were added to 100 parts of the toner particles, followed by mixing to obtain a positively chargeable magnetic toner.

Copying Test

An amorphous silicon photoreceptor drum (A) of 67.5% in Si—O content on the drum surface was loaded in a marketed digital copying machine GP-605 (manufactured by Canon Co., Ltd.), and copying test was conducted using the thus-obtained toner under the environments of ordinary temperature and ordinary humidity (N/N; 23° C., 50% RH), high temperature and high humidity (30° C., 85% RH) and low temperature and low humidity (10° C., 20% RH) to produce 500,000 copies for each environment. As a result of the test, toner-fusing phenomenon was not observed on the drum, and no flaws were observed on the drum under every environment. Further, even after producing 500,000 copies, the image density was stable, less formation of fog was observed, and dusting of toner within the machine and image stain were not observed. In the test under the environment of ordinary temperature and ordinary humidity, image densities (I.D.) at the initial stage and upon production of 500,000 copies were 1.36 and 1.37, respectively, and fogs at the initial stage and upon production of 500,000 copies were 0.4 and 0.2, respectively.

Figure 2:
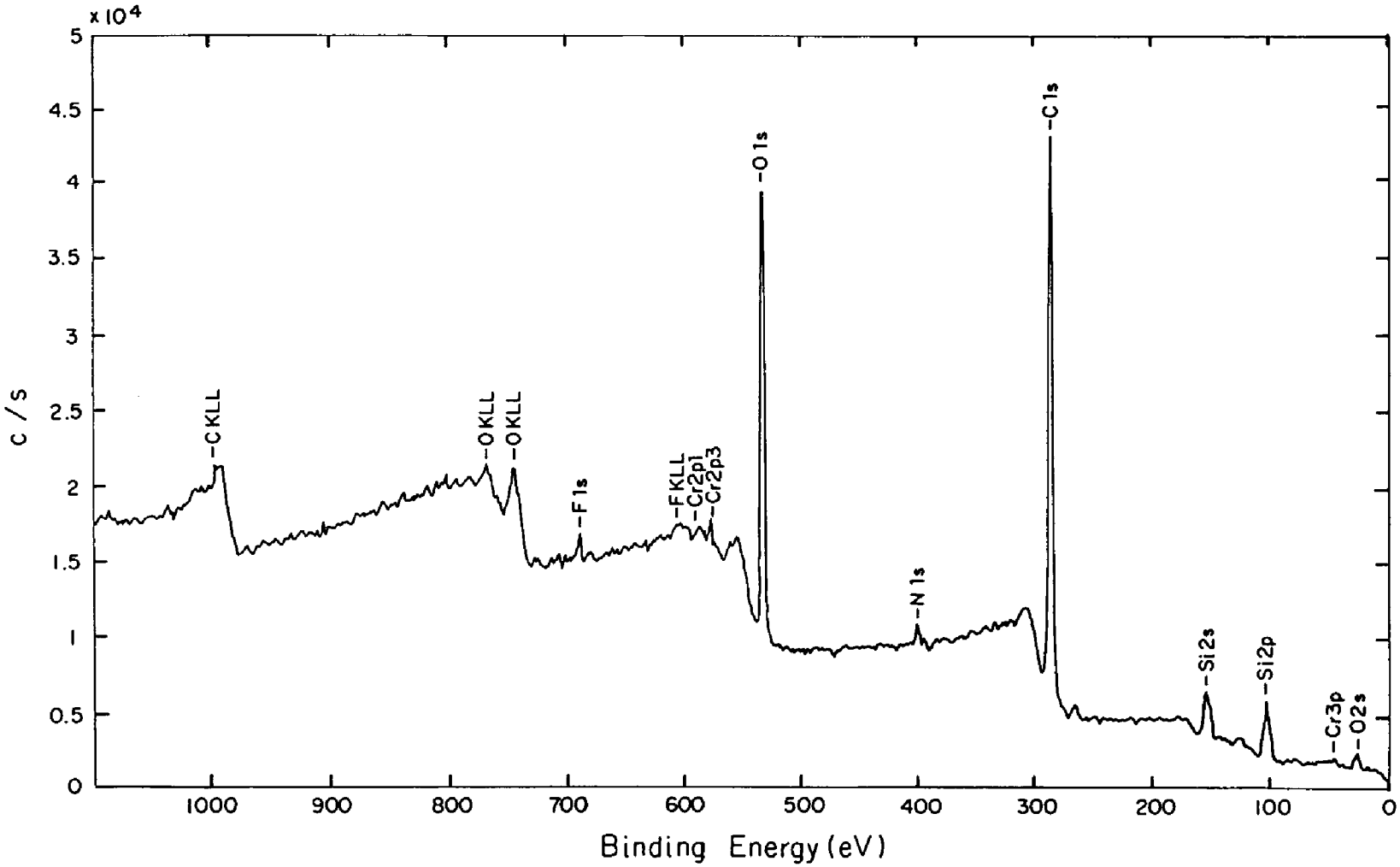
FIG. 2 shows an X-ray photo-electron spectroanalysis spectrum of the surface of the photoreceptor drum used in Example 1 of the invention.
Figure 3:
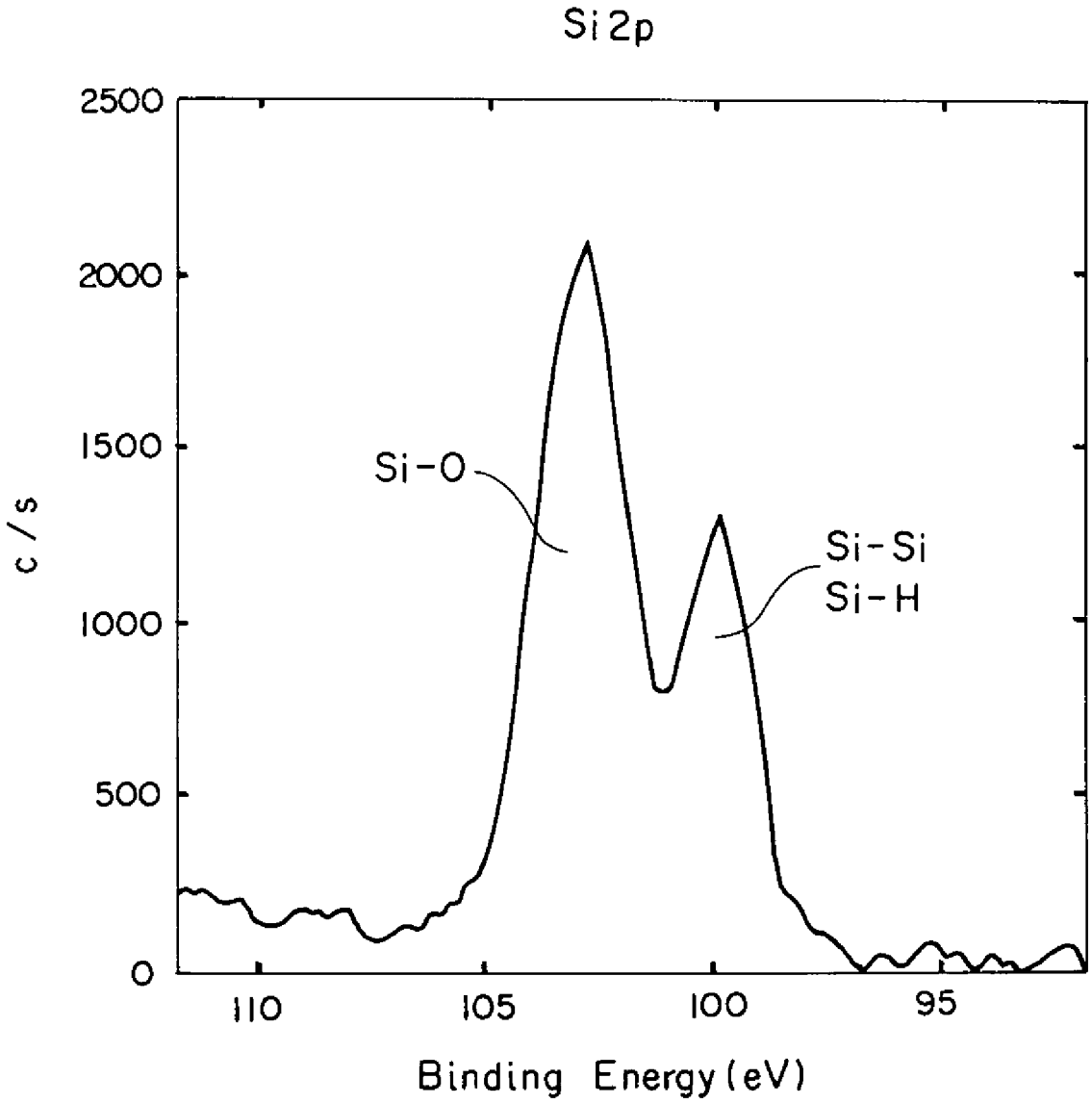
FIG. 3 is a detailed drawing of Si2p spectrum in the spectrum shown in FIG. 2.

The amount (%) of Si—O on the surface of the above-described amorphous silicon photoreceptor drum is a value obtained by the X-ray photoelectron spectroanalysis (Mg std 400.0W 0.0μ117.40 eV). The spectrum obtained by the spectroanalysis is shown in FIG. 2, and the spectrum after separating a peak of Si2p in FIG. 2 is shown in FIG. 3.

In the above procedures, image density was measured by using a Macbeth densitometer, with an image density of 1.35 or more being judged to be an image density of a good image.

Also, fog was determined by measuring reflectivity by means of a photovolt. A fog of 1.2% or less is a good value.

Dusting of the toner within the machine was determined by confirming whether toner particles exist on the transfer charger of the copying machine or not. In case where the toner dusting is observed on the transfer charger, there arises staining of image due to the toner.

In the following Examples, too, the amount of Si—O on the surface of the photoreceptor drum, measurement of image density and fog and confirmation of toner dusting were conducted in the same manner as described above.

EXAMPLE 2

Preparation of Developer 0.4 part of silica fine powder having been treated with dichlorodimethylsilane and 1.0 part of silicon carbide fine powder of 0.32 μm in average primary particle size, 31.6 $m^2/g$ in specific surface area, 52.7% in amount of agglomerated particles, 0.30% by weight in amount of deposited Fe element and 0.437% by weight in amount of deposited Al element were added to 100 parts of the toner particles prepared in Example 1, followed by mixing to obtain a positively chargeable magnetic toner.

Copying Test

An amorphous silicon photoreceptor drum (A) of 67.5% in Si—O content on the drum surface was loaded in a marketed digital copying machine iR8500 (manufactured by Canon Co., Ltd.), and copying test was conducted using the thus-obtained toner under the environments of ordinary temperature and ordinary humidity (23° C., 50% RH), high temperature and high humidity (30° C., 85% RH) and low temperature and low humidity (10° C., 20% RH) to produce 500,000 copies for each environment. As a result of the test, toner-fusing phenomenon was not observed on the drum, and no flaws were observed on the drum under every environment. Further, even after producing 500,000 copies, the image density was stable, less formation of fog was observed, and dusting of toner within the machine and image stain were not observed. In the test under the environment of ordinary temperature and ordinary humidity, image densities (I.D.) at the initial stage and upon production of 500,000 copies were 1.42 and 1.41, respectively, and fogs at the initial stage and upon production of 500,000 copies were 0.5 and 0.9, respectively.

EXAMPLE 3

Preparation of Developer 0.3 part of silica fine powder having been treated with dimethyldimethoxysilane and 1.0 part of silicon carbide fine powder of 0.71 μm in average primary particle size, 22.5 $m^2/g$ in specific surface area, 30.2% in amount of agglomerated particles, 0.18% by weight in amount of deposited Fe element and 0.182% by weight in amount of deposited Al element were added to 100 parts of the toner particles prepared in Example 1, followed by mixing to obtain a positively chargeable magnetic toner.

Copying Test

An amorphous silicon photoreceptor drum (A) of 67.5% in Si—O content on the drum surface was loaded in a marketed digital copying machine iR105 (manufactured by Canon Co., Ltd.), and copying test was conducted using the thus-obtained toner under the environments of ordinary temperature and ordinary humidity (23° C., 50% RH), high temperature and high humidity (30° C., 85% RH) and low temperature and low humidity (10° C., 20% RH) to produce 500,000 copies for each environment. As a result of the test, toner-fusing phenomenon was not observed on the drum, and no flaws were observed on the drum under every environment. Further, even after producing 500,000 copies, the image density was stable, less formation of fog was observed, and dusting of toner within the machine and image stain were not observed. In the test under the environment of ordinary temperature and ordinary humidity, image densities (I.D.) at the initial stage and upon production of 500,000 copies were 1.37 and 1.40, respectively, and fogs at the initial stage and upon production of 500,000 copies were 0.1 and 0.3, respectively.

EXAMPLE 4

Preparation of Developer

| | |
|---|---|
| Polyester resin | 100 parts |
| Magnetic material (magnetite) | 84 parts |
| Salicylic acid series chromium salt | 2 parts |
| Low-molecular polypropylene | 3 parts |

The above-described components were uniformly mixed, kneaded, pulverized, and classified to obtain negatively chargeable toner particles of 10.3 μm in average particle size. Subsequently, 0.2 part of silica fine powder having been treated with dichlorodimethylsilane, 1.0 part of calcium carbonate fine powder having been treated with aminosilane and 0.7 part of silicon carbide fine powder of 0.37 μm in average primary particle size, 27.5 $m^2/g$ in specific surface area, 35.1% in amount of agglomerated particles, 0.17% by weight in amount of deposited Fe element and 0.208% by weight in amount of deposited Al element were added to 100 parts of the toner particles, followed by mixing to obtain a negatively chargeable magnetic toner.

Copying Test

An amorphous silicon photoreceptor drum (B) of 80.0% in Si—O content on the drum surface was loaded in a marketed digital copying machine iR6000 (manufactured by Canon Co., Ltd.), and copying test was conducted using the thus-obtained toner under the environments of ordinary temperature and ordinary humidity (23° C., 50% RH), high temperature and high humidity (30° C., 85% RH) and low temperature and low humidity (10° C., 20% RH) to produce 250,000 copies for each environment. As a result of the test, toner-fusing phenomenon was not observed on the drum, and no flaws were observed on the drum under every environment. Further, even after producing 250,000 copies, the image density was stable, less formation of fog was observed, and dusting of toner within the machine and image stain were not observed. In the test under the environment of ordinary temperature and ordinary humidity, image densities (I.D.) at the initial stage and upon production of 250,000 copies were 1.44 and 1.41, respectively, and fogs at the initial stage and upon production of 250,000 copies were 1.1 and 0.9, respectively.

EXAMPLE 5

Preparation of Developer

| | |
|---|---|
| Polyester resin | 100 parts |
| Magnetic material (magnetite) | 63 parts |
| Salicylic acid series chromium salt | 1 parts |
| Low-molecular polypropylene | 2 parts |

The above-described components were uniformly mixed, kneaded, pulverized, and classified to obtain negatively chargeable toner particles of 12.0 μm in average particle size. Subsequently, 0.05 part of silica fine powder having been treated with dichlorodimethylsilane and 0.15 part by weight of silica fine powder having been treated with hexamethyldisilazane and 1.5 parts of silicon carbide fine powder of 0.26 μm in average primary particle size, 35.2 $m^2/g$ in specific surface area, 21.5% in amount of agglomerated particles, 0.14% by weight in amount of deposited Fe element and 0.135% by weight in amount of deposited Al element were added to 100 parts of the toner particles, followed by mixing to obtain a negatively chargeable magnetic toner.

Copying Test

An amorphous silicon photoreceptor drum (C) of 52.8% in Si—O content on the drum surface was loaded in a marketed analogue copying machine NP-8530S (manufactured by Canon Co., Ltd.), and copying test was conducted using the thus-obtained toner under the environments of ordinary temperature and ordinary humidity (23° C., 50% RH), high temperature and high humidity (30° C., 85% RH) and low temperature and low humidity (10° C., 20% RH) to produce 250,000 copies for each environment. As a result of the test, toner-fusing phenomenon was not observed on the drum, and no flaws were observed on the drum under every environment. Further, even after producing 250,000 copies, the image density was stable, less formation of fog was observed, and dusting of toner within the machine and image stain were not observed. In the test under the environment of ordinary temperature and ordinary humidity, image densities at the initial stage and upon production of 250,000 copies were 1.39 and 1.39, respectively, and fogs at the initial stage and upon production of 250,000 copies were 0.8 and 1.0, respectively.

EXAMPLE 6

Preparation of Developer

| | |
|---|---|
| Styrene-acrylic copolymer | 100 parts |
| Carbon 1 | 8 parts |
| Carbon 2 | 1 part |
| Salicylic acid series chromium salt | 2 parts |
| Low-molecular polypropylene | 4 parts |

The above-described components were uniformly mixed, kneaded, pulverized, and classified to obtain negatively chargeable toner particles of 11.0 μm in average particle size. Subsequently, 0.5 part of silica fine powder having been treated with dichlorodimethylsilane, 0.4 part of polymethyl methacrylate (PMMA) fine particles and 0.5 part of silicon carbide fine powder of 1.00 μm in average primary particle size, 20.7 $m^2/g$ in specific surface area, 32.4% in amount of agglomerated particles, 0.32% by weight in amount of deposited Fe element and 0.188% by weight in amount of deposited Al element were added to 100 parts of the toner particles, followed by mixing to obtain a negatively chargeable non-magnetic toner.

Copying Test

An arsenic-selenium photoreceptor drum of 90 μm in vapor deposited film thickness was loaded in a marketed analogue copying machine M6765 (manufactured by Lanier Co., Ltd.), and copying test was conducted using the thus-obtained toner and ferrite carrier particle coated with silicone as a carrier particle under the environments of ordinary temperature and ordinary humidity (23° C., 50% RH), high temperature and high humidity (30° C., 85% RH) and low temperature and low humidity (10° C., 20% RH) to produce 200,000 copies for each environment. As a result of the test, toner-fusing phenomenon was not observed on the drum, and no flaws were observed on the drum under every environment. Further, even after producing 200,000 copies, the image density was stable, less formation of fog was observed, and dusting of toner within the machine and image stain were not observed. In the test under the environment of ordinary temperature and ordinary humidity, image densities at the initial stage and upon production of 200,000 copies were 1.44 and 1.38, respectively, and fogs at the initial stage and upon production of 200,000 copies were 0.5 and 0.2, respectively.

COMPARATIVE EXAMPLE 1

Preparation of a Developer

A positively chargeable magnetic toner was obtained in the same manner as in Example 1 except for changing the silicon carbide fine powder used in Example 1 to silicon carbide fine powder of 3.03 μm in average primary particle size, 1.71 $m^2/g$ in specific surface area, 0.01% in amount of agglomerated particles, 0.04% by weight in amount of deposited Fe element and 0.004% by weight in amount of deposited Al element.

Copying Test

When copying test was conducted in the same manner as in Example 1 using the thus-obtained toner, white spots were formed on copied papers, which occur in case where abrasion is not sufficient, after producing about 8,000 copies under the condition of ordinary temperature and ordinary humidity (23° C., 50% RH), thus toner particles fusing to the photoreceptor drum.

COMPARATIVE EXAMPLE 2

Preparation of a Developer

A positively chargeable magnetic toner was obtained in the same manner as in Example 2 except for changing the silicon carbide fine powder used in Example 2 to silicon carbide fine powder of 0.11 μm in average primary particle size, 54.5 $m^2/g$ in specific surface area, 88.1% in amount of agglomerated particles, 1.15% by weight in amount of deposited Fe element and 0.754% by weight in amount of deposited Al element.

Copying Test

When copying test was conducted in the same manner as in Example 2 using the thus-obtained toner, silicon carbide agglomerated particles stayed too much at the cleaning blade for the photoreceptor drum after producing about 5,000 copies under the condition of ordinary temperature and ordinary humidity (23° C., 50% RH), thus black streaks being observed on copied papers due to cleaning failure.

COMPARATIVE EXAMPLE 3

Preparation of a Developer

A positively chargeable magnetic toner was obtained in the same manner as in Example 1 except for not adding the silicon carbide fine powder used in Example 1.

Copying Test

When copying test was conducted in the same manner as in Example 1 using the thus-obtained toner, white spots were observed on copied papers, which occur in case where abrasion is not sufficient, after producing about 1,000 copies under the condition of ordinary temperature and ordinary humidity (23° C., 50% RH), thus toner particles fusing to the photoreceptor drum.

COMPARATIVE EXAMPLE 4

Preparation of a Developer

A negatively chargeable magnetic toner was obtained in the same manner as in Example 4 except for adding the silicon carbide fine powder used in Example 4 in an amount of 6.0 parts.

Copying Test

When copying test was conducted in the same manner as in Example 4 using the thus-obtained toner, streaks were observed on copied papers after producing about 50,000 copies under the condition of ordinary temperature and ordinary humidity (23° C., 50% RH), and deep flaws were observed on the photoreceptor which are formed when abrasion is conducted too much.

COMPARATIVE EXAMPLE 5

Copying Test

An amorphous silicon photoreceptor drum (D) of 31.5% in Si—O content on the surface of the drum was loaded in a marketed digital copying machine iR8500 (manufactured by Canon Co., Ltd.) and copying test was conducted using the same positively chargeable magnetic toner as used in Example 2. Streaks were observed on copied papers after producing about 70,000 copies under the condition of ordinary temperature and ordinary humidity (23° C., 50% RH), and deep flaws were observed on the photoreceptor which are formed when abrasion is conducted too much.

Conditions and results of the above-mentioned Examples and Comparative Examples are tabulated in the following Table.

TABLE 1(A)

| | | | SiC | | | | | |
|---|---|---|---|---|---|---|---|---|
| | Content | Drum | *1 μm | *2 $m^2/g$ | *3 % | Fe wt % | Al wt % | Added Amount parts |
| Example 1 | +magnetic | α-Si(A) | 0.42 | 26.3 | 40.6 | 0.21 | 0.25 | 1.0 |
| Example 2 | +magnetic | α-Si(A) | 0.32 | 31.6 | 52.7 | 0.30 | 0.437 | 1.0 |
| Example 3 | +magnetic | α-Si(A) | 0.71 | 22.5 | 30.2 | 0.18 | 0.182 | 1.0 |
| Example 4 | −magnetic | α-Si(B) | 0.37 | 27.5 | 35.1 | 0.17 | 0.208 | 0.7 |
| Example 5 | −magnetic | α-Si(C) | 0.26 | 35.2 | 21.5 | 0.14 | 0.135 | 1.5 |
| Example 6 | −non-magnetic | As—Se | 1.00 | 20.7 | 32.4 | 0.32 | 0.188 | 0.5 |
| Comparative Example 1 | +magnetic | α-Si(A) | 3.03 | 1.71 | 0.01 | 0.04 | 0.004 | 1.0 |
| Comparative Example 2 | +magnetic | α-Si(A) | 0.11 | 54.5 | 88.1 | 1.15 | 0.745 | 1.0 |
| Comparative Example 3 | +magnetic | α-Si(A) | — | — | — | — | — | 0.0 |
| Comparative Example 4 | −magnetic | α-Si(B) | 0.37 | 27.5 | 35.1 | 0.17 | 0.208 | 6.0 |
| Comparative Example 5 | +magnetic | α-Si(D) | 0.32 | 31.6 | 52.7 | 0.30 | 0.437 | 1.0 |

*1: Average particle size

*2: Specific surface area

*3: Amount of agglomerated particles

TABLE 1(B)

| | Evaluation Results on Image | | | | |
|---|---|---|---|---|---|
| | Number of | N/N I.D. | | N/N Fog | |
| | Produced Copies | Start | End | Start | End |
| Example 1 | 500,000 copies OK | 1.36 | 1.37 | 0.4 | 0.2 |
| Example 2 | 500,000 copies OK | 1.42 | 1.41 | 0.5 | 0.9 |
| Example 3 | 500,000 copies OK | 1.37 | 1.40 | 0.1 | 0.3 |
| Example 4 | 250,000 copies OK | 1.44 | 1.41 | 1.1 | 0.9 |
| Example 5 | 250,000 copies OK | 1.39 | 1.39 | 0.8 | 1.0 |
| Example 6 | 200,000 copies OK | 1.44 | 1.38 | 0.5 | 0.2 |
| Comparative Example 1 | White spots were formed due to fusing of toner on a drum after producing about 8,000 copies. | | | | |
| Comparative Example 2 | Cleaning failure was observed due to too much SiC agglomerated particles at a cleaning blade after producing about 5,000 copies. | | | | |
| Comparative Example 3 | White spots were formed due to fusing of toner on a drum after producing about 1,000 copies. | | | | |
| Comparative Example 4 | The drum was injured due to too much abrasion after producing about 50,000 copies. | | | | |
| Comparative Example 5 | The drum was injured due to too much abrasion after producing about 70,000 copies. | | | | |

It is seen from the above Table that good copied images can be formed over an extremely long period of time regardless of whether the toner is a magnetic toner or a non-magnetic toner and whether the polarity is positive or negative, by using the silicon carbide fine powder having an average primary particle size, a specific surface area and an amount of agglomerated particles specified in the invention. Also, it is seen from Comparative Examples that, where the average primary particle size, specific surface area and amount of agglomerated particles are outside the scopes of the invention, there result fusing of toner particles on the photoreceptor, cleaning failure due to residence of silicon carbide fine powder at a cleaning blade, formation of flaws of the photoreceptor due to excess abrasion.

As has been described in detail, the invention provides the excellent advantages that, in the image-forming process involving the step of cleaning an inorganic electrostatic latent image carrier with a blade, fusing of toner onto the electrostatic latent image carrier and cleaning failure are avoided, that no flaws are formed on the electrostatic latent image carrier, that good copied images can be formed for an extremely long period of time regardless of copying environment, and that no dusting of toner particles take place within the image-forming apparatus, thus good copying being conducted stably for an extremely long period of time. These advantages are obtained regardless of whether the electrostatic developer is a positively chargeable developer or a negatively chargeable developer or whether the developer is a one-component developer or a two-component developer.

What is claimed is:

1. An image-forming process involving a step of forming an electrostatic latent image on an electrostatic latent image carrier, a step of developing the thus-formed latent image with an electrostatic image developer, a step of transferring the thus-developed image to a transfer member, a step of fixing the transferred image, and a step of scraping the developer remaining on the electrostatic latent image carrier after the transferring step with a cleaning blade, wherein the electrostatic latent image carrier is constituted by an inorganic material and the developer contains at least toner particles and silicon carbide fine powder of 0.2 to 1.5 μm in average primary particle size, 10 to 50 $m^2/g$ in specific surface area and 10 to 60% in amount of agglomerated particles, said silicon carbide fine powder being contained in an amount of 0.1 to 5.0% by weight based on the toner particles.

2. The image-forming process as described in claim 1, wherein said electrostatic latent image carrier comprises amorphous silicon.

3. The image-forming process as described in claim 2, wherein said amorphous silicon is amorphous silicon containing 50% or more Si—O based on the chemical state of Si derived from the results of peak separation of Si2p spectrum for the surface of the electrostatic latent image carrier in the X-ray photoelectron spectroanalysis.

4. The image-forming process as described in claim 1, wherein said electrostatic latent image carrier is an arsenic-selenium series photoreceptor of 60 to 150 μm in film thickness of vapor deposition film.

5. The image-forming process as described in claim 1, wherein a concentration of Fe element deposited on the surface of said silicon carbide fine powder is 0.5% by weight or less, and a concentration of Al element is 0.6% by weight or less.

6. The image-forming process as described in claim 1, wherein said electrostatic image developer is a one-component magnetic developer.

7. The image-forming process as described in claim 1, wherein said electrostatic image developer is a two-component developer containing a non-magnetic toner.

8. The image-forming process as described in claim 1, wherein said electrostatic image developer further contains other inorganic fine particles than said silicon carbide fine powder.

9. An electrostatic image developer containing at least toner particles and silicon carbide fine powder, wherein the silicon carbide fine powder has an average primary particle size of 0.2 to 1.5 μm and a specific surface area of 10 to 50 $m^2/g$ and contains 10 to 60% of agglomerated particles, said silicon carbide fine powder being contained in an amount of 0.1 to 5.0% by weight based on the toner particles.

10. The electrostatic image developer as described in claim 9, wherein said silicon carbide fine powder is a powder produced by pulverizing silicon carbide powder, classifying by a wet-classifying method to obtain silicon carbide fine particles having an average primary particle size of 0.2 to 1.5 μm, adding an agglomerating agent to the classified aqueous solution to agglomerate and sediment silicon carbide fine particles in the aqueous solution, drying the resultant slurry, and crushing the dried product.

11. The electrostatic image developer as described in claim 10, wherein a concentration of Fe element deposited on the surface of the silicon carbide fine powder is 0.5% by weight or less and a concentration of Al element is 0.6% by weight or less.

12. The electrostatic image developer as described in claim 9, wherein said toner particles are magnetic toner particles.

13. The electrostatic image developer as described in claim 9, wherein said toner particles are non-magnetic toner particles.

14. The electrostatic image developer as described in claim 9, which further contains a carrier.

15. The electrostatic image developer as described in claim 9, wherein said electrostatic image developer further contains other inorganic fine particles than said silicon carbide fine powder.

* * * * *